US005287583A

United States Patent [19]

Lilja

[11] Patent Number: 5,287,583

[45] Date of Patent: Feb. 22, 1994

[54] MACHINE FOR TREATING FLOOR SURFACES

[76] Inventor: Bo V. Lilja, Lorensviksvägen 14, 183 63 Täby, Sweden

[21] Appl. No.: 752,478

[22] PCT Filed: Feb. 27, 1990

[86] PCT No.: PCT/SE90/00133

§ 371 Date: Sep. 6, 1991

§ 102(e) Date: Sep. 6, 1991

[87] PCT Pub. No.: WO90/10415

PCT Pub. Date: Sep. 20, 1990

[30] Foreign Application Priority Data

Mar. 9, 1989 [SE] Sweden ..... 8900836-1
Aug. 21, 1989 [SE] Sweden ..... 8902782-5

[51] Int. Cl.[5] ..... A47L 11/282; A47L 11/34; A47L 11/40

[52] U.S. Cl. ..... 15/98; 15/50.1; 15/144.1; 15/144.2; 15/230; 15/230.16

[58] Field of Search ..... 15/49.1, 50.1, 52.1, 15/52, 98, 385, 230, 180, 230.14, 230.16, 144.1, 144.2; 51/177

[56] References Cited

U.S. PATENT DOCUMENTS 1,401,400 12/1921 Green .
2,039,903 5/1936 Hild ..... 15/50.1
2,252,269 8/1941 McQuown ..... 15/50.1
2,618,798 11/1952 Ohrt ..... 15/50.1
2,774,089 12/1956 Brown .
3,121,895 2/1964 Burgoon .
3,310,828 3/1967 Clark et al. .
4,115,890 9/1978 Burgoon ..... 15/49.1
4,122,576 10/1978 Bevington ..... 15/49.1
4,173,054 11/1979 Ando .
4,209,870 7/1980 Doyel .
4,358,868 11/1982 Cook, Jr. ..... 15/49.1
4,365,377 12/1982 Tood et al. ..... 15/98
4,418,438 12/1983 Cutler ..... 15/98
4,756,042 7/1988 Genovese ..... 15/98
4,881,288 11/1989 May et al. ..... 15/98
4,961,243 10/1990 Barber ..... 15/98

FOREIGN PATENT DOCUMENTS 3315737 10/1984 Fed. Rep. of Germany .
1009424 5/1952 France .
374154 2/1964 Switzerland .
401382 4/1966 Switzerland ..... 15/50.1

*Primary Examiner*—Edward L. Roberts
*Attorney, Agent, or Firm*—Burns, Doane, Swecker & Mathis

[57] ABSTRACT

A floor treatment machine includes a frame, handle mounted to the frame, wheels mounted to the frame, and a rotatable floor treatment pad mounted to the frame for treating a floor surface. The floor treatment machine further includes a device for adjusting the angle of the floor treatment pad with respect to the floor surface. The handle may be mounted to the frame with an attachment that includes a first part that is attached to the frame so as to enable the first part to rotate with respect to the frame about a first axis and second part that is pivotably attached to the first part so as to enable the second part to pivot with respect to the first part about a second axis, and an element for mounting the handle to the second part.

19 Claims, 2 Drawing Sheets

Fig. 6
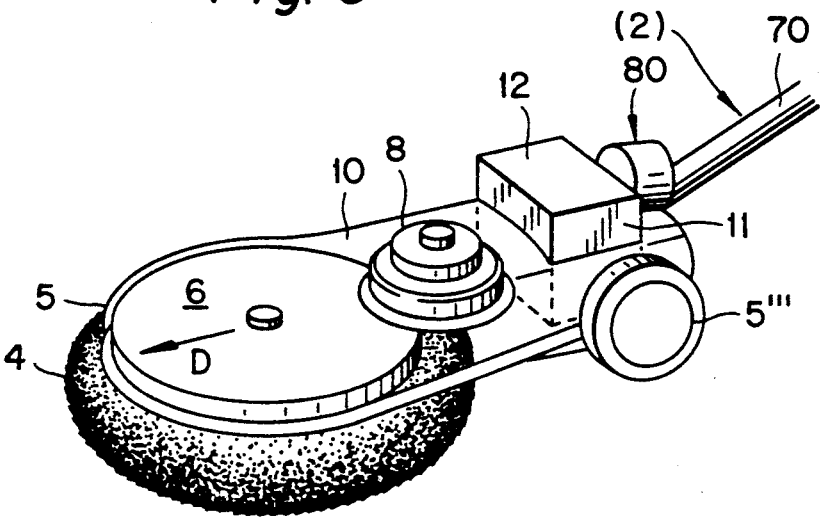
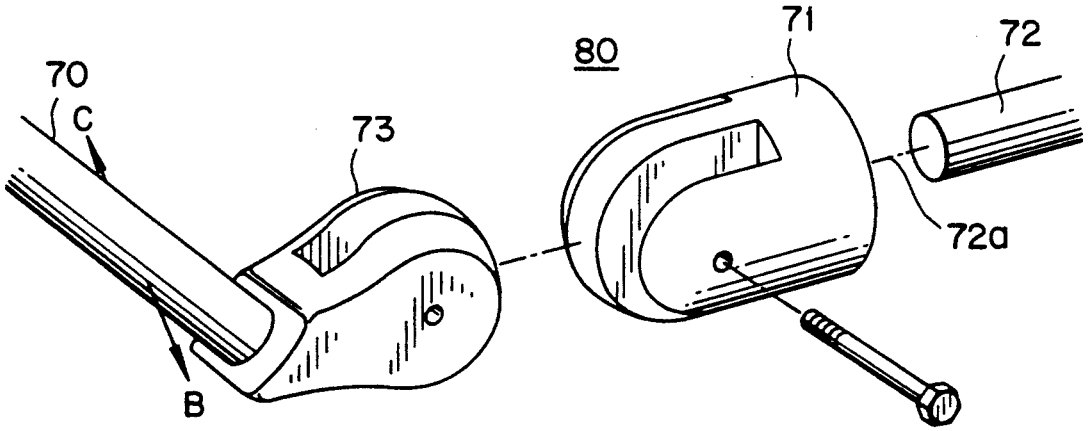
Fig. 7

MACHINE FOR TREATING FLOOR SURFACES

TECHNICAL FIELD

The present invention relates to a machine intended for treating floor surfaces, and in particular to one such machine which comprises a handle by means of which the machine is guided over the surface of a floor, a number of wheels on which the machine is displaced over the floor or floor surface and which co-act with the bottom part of said handle, and a rotatable pad or like device which is mounted at a distance from the bottom part of said handle and which is operative to treat said floor or floor surface.

When reference is made to "moving" the machine, this implies that the machine is moved on its wheels over the floor surface without carrying out a working function.

When reference is made to "displacing" the machine, this implies that the machine is moved over the floor surface while carrying out a working function.

The present invention relates to an arrangement in a floor-treating machine, such as a floor-washing or floor-mopping machine, and particularly, but not exclusively, to an arrangement for controlling a machine of the kind which rests on a surface to be treated (a floor surface) via a pad-supporting rotatable disc and a number of wheels, preferably two wheels, mounted on a common axle.

BACKGROUND PRIOR ART

Various different types of floor-treating machines are known to the art, these machines being adapted to the floor-treatment function concerned, i.e. floor-washing, floor-polishing or floor rubbing-down functions.

It is known to dimension the machines to suit different working conditions, such as the conditions of smaller office premises, large office premises, warehouses, stores, etc., and consequently such machines are retailed in various sizes ranging from large, driven machines to hand-maneouvred small machines.

It is also known to operate larger machines with the aid of robotic devices and also to remotely control these machines.

the present invention relates to a smaller manually operated floor-treatment machine held by a walking operator, and is concerned essentially with machines of similar construction to smaller floor polishing machines.

Small polishing machines which are guided manually for movement over the floor surface by a walking operator are known to the art. Such machines comprise a handle which is operative to guide the machine for movement over the floor surface, a pair of wheels co-acting with the lower part of the handle and operative to move the machine along the floor, and a polishing brush which is mounted at a distance from the lower part of the handle and which rotates about a vertical axis.

In the case of machines of this kind, the wheel-pair is used solely to move the machine from one polished floor surface to a floor surface to be polished, while the actual polishing function is effected solely by rotating the polishing brush against the floor surface with the wheel-pair spaced vertically therefrom.

When using such a machine, polishing is effected by applying a lateral force to the handle and permitting the electrically-driven brush to swing forwards and backwards, normally in a semi-circular movement, through an angle of about 90°.

The polishing brush, which rotates about a vertical axis, will normally have a relatively hard, nylon surface of the type "Scotch Brite" and the brush will work the floor surface at full machine pressure, e.g. a pressure of 37–75 kg.

In the case of known devices for controlling or manoeuvring machines and assemblies of the aforedescribed kind, the lower part of a column or a U-shaped handle structure is connected to the machine by means of a horizontal pivot shaft, such that the manoeuvring device is able to swing up and down about a horizontal pivot axis extending transversely to the normal movement-direction of the unit. The upper part of said column is configured as a handle.

SUMMARY OF THE PRESENT INVENTION

Technical Problems

When considering the present state of the art, as described above, it will be seen that a technical problem resides in realizing that the basic construction of a known polishing machine comprising a handle for guiding the machine in its movement over the floor surface, a wheel-pair which co-acts with the lower part of the handle and by means of which the machine is moved over said floor or floor surface, and a rotatable brush which is located at a distance from the lower part of said handle and by means of which the floor surface is treated, can be made the starting point for a development which, subsequent to new guidelines and basic features, can provide a floor-washing and floor-mopping machine by means of which a floor surface can be treated with a relatively large quantity of liquid and the floor surface, or corresponding foundation surface, cleansed of dirt which lies and/or adheres thereto.

Another technical problem resides in the provision of a machine which works in accordance with the washing-and-mopping principle and which when treating the floor surface, with the aid of a pad which rotates about a vertical axis, can be displaced over said floor surface with the aid of the handle and said wheel-pair.

A further technical problem resides in the provision of a pad which is so configured and constructed that said pad will have no detrimental effect on guiding the machine and its movement over the floor surface while the pad rotates.

Another technical problem is one of realizing that such a rotatable, wet pad shall act on the floor surface with only a small weight or pressure, so that a washing-and-mopping operation can be carried out in a simple and ready fashion.

It will also be seen that a technical problem resides in realizing within which pressure ranges the rotatable, wet pad should act on the floor surface in order to provide a good floor-washing and floor-mopping result with small or compensated lateral force, while adapting energy consumption.

It will also be seen that a technical problem resides in supplying liquid, either continuously or intermittently, to the bottom treatment-surface of the pad and to realize the advantages that are afforded when liquid is supplied from above through the rotational centre of the pad or in the vicinity of said centre.

It will also be seen that a technical problem resides in realizing the significance of rotating the liquid-saturated, or wet, pad within a well-defined range of revolutions so as to obtain a practical washing-and-mopping function and so as to achieve a desired floor-cleaning effect with little or no lateral forces generated by the rotating pad and with restricted energy consumption.

It will also be seen that a further technical problem is one of realizing the significance of the nature and/or configuration of the pad when said pad per se is removably attached to a downwardly facing surface of a pad-supporting disc. Another technical problem is one of realizing that in order to achieve an effective washing-and-mopping function, the pad must comprise substantially a moisture-absorbing material, such as wool, cotton or the like, and that a non-moisture-absorbing, stiffer material, such as nylon bristles should be provided at given, discrete locations on the underside of the pad.

It will also be seen that a technical problem resides in realizing that the non-absorbing material in the discrete locations on said pad should extend slightly beneath the plane of the remaining pad material, so as to achieve effective treatment of the floor surface and to provide controlled compensation for the lateral forces generated as the pad rotates against the floor surface under pressure.

A further technical problem resides in realizing that the requisite washing-and-mopping function requires a given polishing effect, and that a limited polishing effect can be obtained with low resistance, by providing solely a part of the floor-treating surface with a polishing brush means.

It will also be seen that a technical problem is one of providing discrete localities of mutually different configurations and different positions on the treating-surface of said pad, so as to provide a rotatable pad which is adapted for use with a washing-and-mopping machine which is driven at low power inputs and low energy consumption, implying that an electrically-operated d.c. motor can be mounted on the machine and driven by batteries carried thereby, preferably rechargeable batteries.

A further technical problem is one of mounting the batteries on the machine in a position in which the weight of the batteries will act primarily on the wheels and not on the rotatable pad.

A highly qualified technical problem is one of realizing that the wheel-pair and pad of the washing-and-mopping machine shall constitute three support surfaces necessary to support the machine as a whole on the surface of a floor or like foundation to be cleaned, particularly when the machine is in operation.

Another technical problem is one of realizing that the pad shall be adjustable in relation to a horizontal plane, preferably via a shaft which is common to the wheel-pair, so as to be able to compensate for the lateral forces otherwise generated by the rotatable, wet pad as seen in the direction of displacement of the machine.

When considering the present state of the art and in particular the present state of the manoeuvring devices and their attachment to such machines, it will be seen that a technical problem resides in realizing that the manoeuverability of the machine can be improved when using a lower attachment of the manoeuvring device and to permit a pin to extend horizontally, or substantially horizontally, in the normal direction of movement of the machine, or at right angles to the axis rotation of the wheels and to be positioned centrally between said wheels.

A further technical problem is one of realizing the advantages that are afforded when the manoeuvring device is attached in the aforedescribed manner, such as to improve the manoeuverability of the machine, particularly when the machine is used as a floor-washing and floor-mopping machine.

A more advanced technical problem resides in realizing that the machine can be manoeuvred easily and with the application of only a small force, when the floor-washing and floor-mopping machine is constructed in accordance with the teachings mentioned above.

A further technical problem is one of providing a manoeuvring device which is manufactured from simple components having sufficient flexural rigidity to provide simple means for controlling machines usable within this technical field.

It will also be seen from a study of the prior art that a technical problem resides in realizing the significance of attaching the sleeve or the pin to a holder which is attached to the machine by means of a hinge device having a horizontal hinge axle, so that the handle and the tubular element can be swung up and down as compared with the rotation afforded by previously known units.

A further technical problem is one of realizing the practical significance of providing the machine with a clamping device in the vicinity of the aforesaid attachment whereby the tubular element can be held by said clamping device in a vertical position or in a position in which the tubular element is inclined over the pad and the pad-support disc, such that the handle will be located over said pad.

Another technical problem is one of realizing the significance of curving the aforesaid bend within predetermined limits, so as to enable the machine to be steered with the application of small forces.

It will also be seen that a further technical problem resides in realizing that the forces acting on the wheels increase when the direction of the machine is changed, therewith generating increased friction which is operative to turn the pad-support disc and the pad in the desired, new direction of travel.

It will also be seen that a technical problem resides in realizing that the aforedescribed attachment of the manoeuvring device to a floor-washing or floor-mopping machine enables the pad to be pivoted readily within a range of approximately 90° and even within a larger range.

SOLUTION

The present invention is intended to solve one or more of the aforesaid technical problems encountered in floor-treating machines which comprise a handle operative to guide the machine over the surface of a floor or like foundation surface, wheels which co-act with the lower part of the handle and operative to move the machine across said floor, and a rotatable, floor-cleaning pad which is mounted on the machine at a distance from the lower part of said handle.

With a starting point from a machine of this construction, it is proposed in accordance with the present invention that a pad which rotates about a vertical axis shall be so arranged that when saturated with liquid it will act with only a small weight on the floor surface being cleaned, and that said pad, with the aid of said handle and wheels, can be displaced preferably in a straight line over the floor surface so as to achieve a washing or mopping function.

In accordance with preferred embodiments lying within the scope of the invention, it is proposed that the pad shall be arranged to act on the floor with a weight of less than 10 kg, preferably 4–8 kg.

It is also proposed that liquid is supplied to the undersurface of the pad through a hose extending from a liquid container, and that this liquid is preferably supplied from above to the rotational centre of the pad, or to a location in the vicinity of said centre.

It also lies within the scope of the invention to rotate the pad at a speed of less than 300 r.p.m., preferably 250–150 r.p.m.

According to one preferred embodiment of the invention, the upper surface of the pad is removably attached to the downwardly facing surface of a pad-supporting disc, and the pad comprises substantially a moisture-absorbing material, such as wool, cotton or the like. According to a further development of the invention, certain areas of the undersurface of the pad form discrete locations which accommodate a stiffer, non-absorbent material, such as nylon bristles.

The stiffer, non-absorbent material in said discrete localities will preferably extend below the plane of the moisture-absorbing material from which the remainder of the floor-treating surface of the pad is composed. The discrete locations in the undersurface of the pad will preferably have the form of a stiff bristle-material, whereas the material from which the remainder of the pad is composed, and at least the undersurface of said pad, is comprised of a softer material of looped or eyelet configuration.

The discrete localities can be coordinated and given the configuration of mutually parallel strips which cover at least 10%, preferably 25%, of the total surface area of the pad.

In accordance with an alternative embodiment, it is proposed that the discrete locations are coordinated to form a spiral which extends from the centre of the pad, or from the vicinity of said centre, to the periphery of the pad or to the vicinity of said periphery.

The spiral should preferably have between 0.25 and 10 revolutions with one or more starts.

According to a further development of the invention, an electrically-driven, d.c. motor is mounted on a plate adjacent the lower part of the handle and close to the wheels, and an endless belt is provided for driving the pad and the pad-support disc in either one of two directions of rotation, via the motor. A switch may be provided for changing the polarity of current supply to the motor and therewith enable the direction of rotation to be changed, the current being supplied from one or more batteries.

The batteries can be mounted on the plate, adjacent the wheels, so that the weight of the batteries will act substantially on the wheels and the wheel axle.

The wheel-pair and cleaning pad of the inventive machine will afford the requisite surfaces for supporting the machine on the floor, and measures are taken to ensure that the pad will act on the floor surface solely with a limited force.

In accordance with a further development of the invention, the wheel-pair co-acts with an axle positioned adjacent the lower part of the handle, and the plate and pad can be adjusted to an oblique position in relation to the horizontal, so as to compensate for the laterally directed force generated by the rotatable pad, as seen in the forward direction of movement of the machine.

In accordance with another embodiment of the invention, the lower part of the handle is pivotally connected to the plate and means are provided for locking the handle in a vertical position.

The pad-support disc is preferably made of a rigid material and the peripheral edge of the pad will preferably extend beyond the peripheral edge of the pad-support disc.

In accordance with the present invention, the machine is provided with a control or steering device by means of which the direction of movement of the machine can be readily changed. The control arrangement includes an attachment means which is mounted adjacent said wheels and which is intended for connecting a maneuvering device to the machine, said maneuvering device including a handle which is intended to be gripped by both hands of a machine operator.

ADVANTAGES

Those advantages primarily associated with an inventive floor-treating machine reside in the provision of a machine which has a floor-washing and floor-mopping function. The machine can be readily maneuvered manually by a walking operator, without the rotating, wet pad needing to generate troublesome lateral forces, since these forces can be compensated for and since the washing or mopping function of the machine can be effected more rapidly and in a more simple fashion than with manual force.

Furthermore, the machine can be used to wash and mop floor spaces located beneath cupboards chairs and other furnishings.

Furthermore, the pad rests on the floor surface with the minimum of force, with the largest part of the weight of the machine being supported by the wheel-pair.

Those advantages primarily associated with a steering arrangement and a manoeuvring device constructed in accordance with the present invention reside in the creation of conditions which will enable the direction of movement of a floor-washing machine to be changed in a simple and ready manner with the application of only a small force. This enables the machine to be moved more readily beneath cabinets and around the legs of tables, chairs and like furnishings.

The main characteristic features of an inventive floor-treating machine are set forth in the characterizing clause of the following Claim 1.

BRIEF DESCRIPTION OF THE DRAWINGS

The invention will now be described in more detail with reference to preferred embodiments thereof illustrated in the accompanying drawings, in which FIG. 6 is a perspective view of a second embodiment of a machine and FIG. 7 is a perspective view of a steering arrangement.

DESCRIPTION OF PREFERRED EMBODIMENTS

Figure 1:
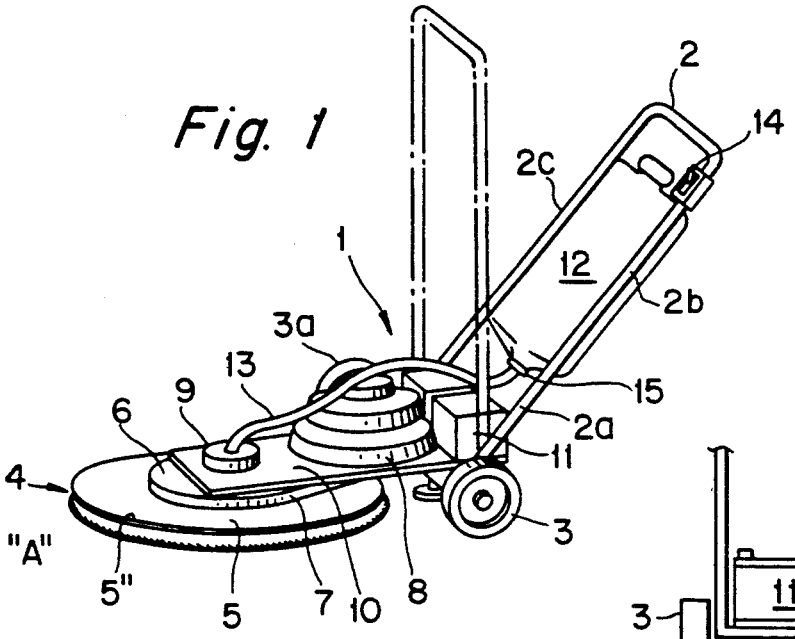
FIG. 1 is a perspective view of a first embodiment of a machine.

FIG. 1 illustrates in perspective a machine 1 which is intended for treating a floor surface "A" and which comprises a handle 2 which is operative to guide the machine for movement over the floor surface, a number of wheels 3, 3a which co-act with the lower part 2a of the handle and by means of which the machine is moved and displaced over the floor or floor surface, and a rotatable floor-treatment pad 4 which is mounted at a distance from the lower part 2a of the handle.

The pad 4 is fitted to a pad-support disc 5 in a known manner, and the support disc 5 is firmly connected to a horizontally disposed wheel 6. The support disc 5 is driven by an endless belt 7 which passes around the wheel 6, by means of an electric d.c. motor 8.

The pad-support disc 5 and the wheel or pulley 6 are journaled on a plate 10 by journal means 9, said plate also carrying said motor 8.

The reference numeral 11 identifies a battery pack, which is also carried by the plate 10.

The handle 2 has a U-shaped configuration, comprising parallel arms 2b and 2c. Mounted between the arms 2b and 2c is a container 12 which contains a liquid, such as water or water-diluted solvent. The liquid is delivered through a hose 13 to a centre hole used for attachment of the pad-support disc 5 to the plate 10, thereby enabling liquid to be supplied to the pad through the rotational axle, said liquid being permitted to seep through the pad to the rotational centre thereof.

The reference numeral 14 identifies an electric switch, which in a first postion connects current in a first direction or polarity to the motor 8, thereby causing the pad 4 to rotate in a direction commensurate with the current supply. When the switch 14 occupies a second position, current is supplied in an opposite direction, thereby forcing the pad to rotate in an opposite direction.

It will be seen that the lower part 2a of the handle 2 is pivotally attached to the wheel axle 3b, and the machine is intended to be displaced over the floor surface with the aid of a high weight-load acting on the wheel-pair 3, 3a and a low weight-load acting on the pad 4. The handle 2 is used by the operator, essentially only to guide the machine over said floor surface.

In accordance with the present invention, the liquid-laden pad 4 is arranged to act on the floor surface "A" with only a small weight, while the machine is displaced over the floor surface "A" on the wheels 3, 3a so as to effect a floor-swabbing or mopping function.

Figure 4:
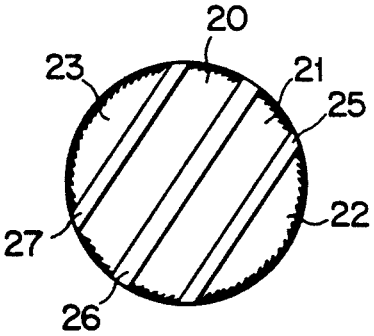
FIG. 4 is a horisontal view of the floor-wetting surface of the pad.
Figure 5:
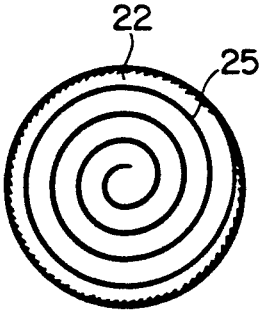
FIG. 5 illustrates an alternative embodiment of a floor-wetting surface.

The embodiment illustrated in FIG. 1 is adapted to exert a pressure on the floor surface of between 4 and 5 kg, which is found to be a suitable pressure when the pad used has the configuration illustrated in FIGS. 4 and 5. The illustrated pad is also advantageous in respect of the current consumed in relation to the cleaning result achieved.

It will be understood that although, according to the foregoing, liquid is supplied from the liquid container 12 to the rotational centre of the pad 4, through the hose 3, that the liquid can also be delivered to the vicinity of said rotational centre.

The illustration embodiment is provided with valve means 15, by means of which liquid can be supplied to the pad continuously or intermittently as required. It is particularly suitable for the liquid delivered to the pad to spread from the rotational centre out towards the periphery of the pad 4, e.g. as a result of the configuration of said pad and as a result of the centrifugal force generated as the pad rotates.

In order to achieve an acceptable floor-treatment result and desired distribution of liquid while taking into account the construction of the pad, the pad is preferably rotated at a speed of less than 300 r.p.m. in normal cases. Higher speeds have been found to generate excessively large lateral forces and, above all, result in excessive energy consumption. It is found in practice that an optimum rotational speed is from 250 to 150 r.p.m., the embodiment illustrated in FIG. 1 being adapted to a pad-speed of 200 r.p.m.

The pad 4 is removably attached to the downwardly facing surface of the pad-support disc 5, and is comprised totally or at least substantially of a moisture-absorbing material, such as wool, cotton and the like.

In FIG. 4, the reference numerals 20, 21, 22 and 23 identify those regions in which a purely moisture-absorbent material is provided, whereas the reference numerals 25, 26, 27 identify "discrete" locations in the pad, these locations comprising strips of non-absorbent and stiffer material than the remaining pad material, such as nylon bristle, for example.

Figure 3:
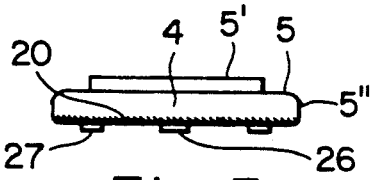
FIG. 3 is a side view of a proposed pad.

As illustrated in FIG. 3, the lower extremities of the bristles 26, 27 extend beyond the lowermost surface of the pad 4 through a given distance.

This given distance will preferably not exceed 10 mm, and will preferably be about 5 mm or slightly less, depending on the chosen weight and the positioning and surface area of the discrete locations. These discrete locations shall have the form of a stiff brush, whereas the remainder of the pad material will have a looped or eyelet form.

As will be seen from FIG. 4, the discrete localities formed in the lowermost or floor-wetting surface of the pad have the form of mutually parallel strips which cover at least 10% of the total surface area, although not more than 30% of said area.

In the case of the FIG. 5 embodiment, the discrete locations have been coordinated and arranged to form a spiral which extends from the centre of the pad, or the near vicinity of said centre, to the periphery of said pad or the near vicinity of said periphery. Thus, when the pad rotates in a first direction, the liquid will be conducted outwardly as a result of centrifugal force generated by rotation and the configuration of said brush, whereas when the pad rotates in the opposite direction, the liquid will be displaced in towards the centre of the pad.

The extension and pitch of the spiral is preferably selected so that said spiral comprises between 1 and 10 revolutions with one start, preferably between 3 and 5 revolutions. The spiral will preferably cover more than 10%, although at most 40%, of the total surface area of the pad.

It will be understood that the greater the surface covered by the discrete localities, the greater the polishing effect achieved, and vice-versa. The polishing result is found to be less than satisfactory when a light pressure is chosen.

The size and configuration of the surface preferably depends on the fact that the discrete locations facilitate rotation of the pad 4 and that the remaining part 20, 21, 22 and 23 of the pad passes over the floor surface with only a very small pressure thereon.

As before mentioned, the electrically-driven d.c. motor 8 is mounted on a plate 10 adjacent the lower part 2a of the handle 2 and that an endless belt 7 is operative to drive the pad 4 and the pad-support disc 5 in either one of two directions.

The distance between the motor 8 and the rotational centre (9) of the pad 4 is made as short as possible, without needing to depart from the requirement of a good drive in the absence of excessive slipping. The motor 8 is positioned as close as possible to the wheel-pair 3, 3a, so that the weight of the motor 8 will act to a large extent on the wheel-pair 3, 3a.

The switch 14 is constructed to switch the polarity of the current supply to the motor 8 in a known manner, therewith to change the direction of rotation of said motor. The current is supplied from one or more batteries 11.

The batteries are also preferably positioned on the plate 10, adjacent the wheel-pair 3, 3a, so that the greatest possible weight is place on said wheel-pair. This weight is amplified by the weight of the container 12 attached to the handle 2, the lower part of which supports on the wheel-pair.

The plate 10, the pad-support disc 5, the pad 4, the motor 8, the battery 11 can be considered to form a unit, and the wheel-pair 3, 3a and the pad 5 form the requisite support surfaces for supporting the machine on the surface of a floor as the machine is displaced along said floor surface, whereas the handle 2 serves only to manipulate and guide the machine over said floor surface.

As before mentioned, the speed at which the pad 4 rotates, the configuration of the undersurface of the pad, and the force at which the pad 4 acts on the floor surface would create a laterally acting force as seen in the forward direction of movement of the machine, which would need to be compensated for by the exertion of an opposing force on the handle 2, unless measures were taken to prevent the occurrence of such laterally acting forces.

Figure 2:
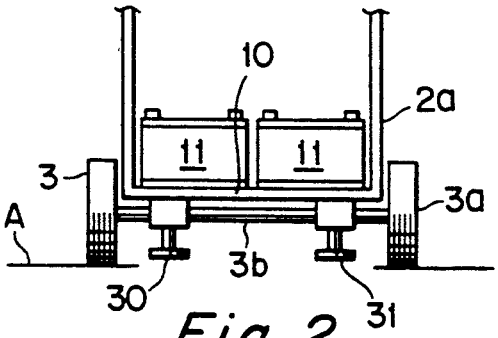
FIG. 2 illustrates a preferred attachment of the axle of a wheel-pair to a plate for laterally positioning the plate with the aid of adjustment means.

This tendency towards lateral movement can be compensated for in accordance with the embodiment illustrated in FIG. 2, by virtue of the fact that the plate 10, the pad-supporting disc 5 and the pad 4 can be positioned obliquely in relation to the horizontal plane via the wheel-pair 3, 3a, preferably with the aid of the axle 3b co-acting with said wheel-pair, so as thereby to compensate the laterally acting force generated by the pad 4 as it rotates. This is effected with the aid of a screw 30 and a screw 31, by means of which either one of the edges of the plate 10, or both edges of said plate, can be raised or lowered on one or the other side of the lower part 2a of the handle.

It is also proposed that the lowermost part 2a of the handle 2 is pivotally connected to the plate or to the axle 3b, and that means are provided for locking the handle in a vertical position relative to the plate 10. This is illustrated in broken lines in FIG. 1.

The locking arrangement required herefore is not shown for reasons of simplification.

It should be noted, however, that with the handle locked in a vertical position, it is possible to move the machine over the floor surface by angling the handle so that the machine will roll solely on the wheel-pair with the pad 4 at an angle to the floor surface.

The case of the FIG. 3 embodiment, the pad-support disc 5 is stiffened by an additional plate 5', and the periphery of the pad 4 extends beyond the peripheral surface 5" of the pad-support disc 5.

The pad-support disc 5 is preferably made of a plastics material and may have different diameters. The diameter of the disc may lie within the range of 30–45 cm.

In FIG. 6 is shown a second embodiment of a machine having a single rod 70 as a manoeuvering device and in this embodiment corresponding parts have been given the same reference numerals as in FIG. 1.

FIG. 7 is a perspective view of a steering arrangement and an attachment means having a first part 71 rotatably attached to a horizontal pin 72 by any suitable known means, such as by the attachment design used to attach handle 1 to cleaning head H, as shown in FIGS. 3 and 4 of U.S. Pat. No. 3,310,828.

Said first part 71 is pivotably connected to a second part 73, the axis of which is horizontal and arranged perpendicularly to the pin 72.

This construction affords a possibility to turn the rod 70 in two different planes.

The attachment means 80 is positioned centrally between the wheels 5''', so as to thereby obtain an equivalent change in direction of movement of the machine in response to pivotal movement of the handle 70 about the pivot axis 72a in the direction of the arrow "B" or "C" respectively. If the attachment 80 is displaced to the left, it can be expected that the machine will be more readily manoeuvred to the right.

Furthermore, the floor-washing or floor-mopping unit 1 can be dimensioned and constructed so that rotation of the pad 4 will exert a smaller force on the unit 1 in the direction of the arrow "D", thereby enabling the floor-washing unit to be manoeuvred with a light pressure on the handle 7.

The construction of the floor-washing unit, however, is such that force activation in a direction opposite to the direction "D" can be arranged, if so desired.

The width of the handle 70 is preferably equal to or slightly smaller than the width or diameter of the pad 4.

In the case of the illustrated, exemplifying embodiment, when the machine is turned, the normal-pressure on the wheels 5''' will be slightly higher than the pressure on said wheels when the machine is moved in a straight line.

Pivoting of the handle 70 in the direction of the arrow "C", will not only force down the part 71, therewith increasing the pressure on the wheels, but will also cause the pad or swab 4 to turn or move in the direction of the arrow "C", with the centre of rotation located adjacent the attachment 80.

The extent to which the pad 4 pivots or the extent to which the wheels 5''' glide along the floor 2 when the manoeuvring device 6 is pivoted, depends on the prevailing frictional forces.

A rotating pad 4 will normally exert a low frictional force.

It will be understood that the invention is not restricted to the aforedescribed exemplifying embodiments, and that modifications can be made within the scope of the following claims.

I claim:

1. A floor treatment machine, comprising:

a frame;

a handle mounted to said frame by means of an attachment means;

wheels mounted to said frame;

a rotatable floor treatment pad mounted on said frame;

said attachment means including:

a first part that is attached to said frame so as to enable said first part to rotate with respect to said frame about a first axis;

a second part pivotably attached to said first part so as to enable said second part to pivot with respect to said first part about a second axis;

means for mounting said handle to said second part.

2. A machine according to claim 1, wherein liquid is supplied through the rotational centre of the pad via a liquid container and hose.

3. A machine according to claim 1, wherein an electrically-driven d.c. motor is mounted on a plate adjacent the handle, and in that the motor is operative to drive the pad in a selected one of two directions, with the aid of an endless belt.

4. A machine according to claim 3, characterized in that batteries are placed on the plate adjacent the wheels.

5. The machine of claim 1, wherein said first axis extends horizontally in a direction of travel of said machine.

6. The machine of claim 5, wherein said second axis is perpendicular to said first axis.

7. The machine of claim 1, further comprising means for adjusting the angle of the floor treatment pad with respect to the floor.

8. The machine of claim 7, further comprising an axle for mounting said wheels to said frame; and said adjusting means includes means for changing the relationship between said axle and said frame.

9. A floor treatment machine, comprising:

a frame;

a handle mounted to said frame;

wheels mounted to said frame;

a rotatable floor treatment pad mounted to said frame for treating a floor surface;

said pad includes a section thereof that is formed from a material that is stiffer than a remainder of the pad, said section starts at a rotational center of the pad and extends in a spiral configuration to a periphery of the pad; and means for supplying liquid through a rotational center of the pad.

10. A machine according to claim 9, wherein the pad actson the floor surface with a force of less than 10 kg.

11. A machine according to claim 10, characterized in that liquid is supplied through the rotational centre of the pad via a liquid container and a hose.

12. A machine according to claim 9, wherein the pad is removably attached to a downwardly facing surface of a pad-support disc.

13. A machine according to claim 12, characterized in that the material disposed in said discrete locations extends beyond the lowermost surface of the reminder of the pad material.

14. A machine according to claim 13, characterized in that the material disposed in said discrete locations has the form of bristles, whereas the remainder of the pad material comprises a moisture-absorbent material of looped or eyelet configuration.

15. The machine of claim 19, further comprising means for adjusting the angle of the floor treatment pad with respect to the floor.

16. The machine of claim 15, further comprising an axle for mounting said wheels to said frame; and said adjusting means includes means for changing the relationship between said axle and said frame.

17. The machine of claim 16, further comprising attachment means for mounting said handle to said frame, said attachment means including:

a first part that is attached to said frame so as to enable said first part to rotate with respect to said frame about a first axis;

a second part pivotably attached to said first part so as to enable said second part to pivot with respect to said first part about a second axis; and means for mounting said handle to said second part.

18. The machine of claim 9, wherein the section comprises a nonabsorbent material.

19. The machine of claim 18, wherein the nonabsorbent material is nylon.

* * * * *